US006325658B2

(12) United States Patent
Aoyama

(10) Patent No.: US 6,325,658 B2
(45) Date of Patent: Dec. 4, 2001

(54) INSULATION-DISPLACEMENT TERMINAL FITTING AND PRODUCTION METHOD THEREFOR

(75) Inventor: Masahiko Aoyama, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/735,210

(22) Filed: Dec. 12, 2000

(30) Foreign Application Priority Data

Dec. 14, 1999 (JP) ..... 11-354096

(51) Int. Cl.[7] ..... H01R 4/24
(52) U.S. Cl. ..... 439/397; 439/406; 439/407
(58) Field of Search ..... 439/397, 398, 439/399, 400, 406, 407

(56) References Cited

U.S. PATENT DOCUMENTS 3,867,005 * 2/1975 Hoppe, Jr. ..... 439/397
4,040,702 8/1977 McKee et al. ..... 439/397
4,057,314 11/1977 Mathe et al. .
4,427,251 * 1/1984 Mathe et al. ..... 439/397
4,940,425 * 7/1990 Hass et al. ..... 439/397
5,549,483 * 8/1996 Hotea ..... 439/399
6,012,942 * 1/2000 Volstorf ..... 439/397

FOREIGN PATENT DOCUMENTS 0 722 197 7/1996 (EP) .
1 490 197 10/1977 (GB) .

* cited by examiner

*Primary Examiner*—Tho D. Ta
(74) *Attorney, Agent, or Firm*—Anthony J. Casella; Gerald E. Hespos

(57) ABSTRACT

An insulation displacement terminal fitting is provided to avoid cracks when V-shaped blades (16) are embossed into the terminal fitting. A deformation-facilitating portion (17) is formed in the terminal fitting for increasing a stretching degree of a portion of a side wall (15) that becomes an edge (16A) at the leading end of the V-shaped blade (16). The deformation-facilitating portion (17) includes a weakened portion (17A) and at least one connecting portion (17B) at locations on the blade (16) continuous with the side wall (15). Since connecting portions (17B) of the deformation-facilitating portion (17) are stretched to a large degree during embossing, a stretching degree of a portion near the edge (16A) can be small, thereby preventing cracks in the edge (16A).

11 Claims, 7 Drawing Sheets

INSULATION-DISPLACEMENT TERMINAL FITTING AND PRODUCTION METHOD THEREFOR

BACKGROUND OF THE INVENTION

1. Field of the Invention

The present invention relates to an insulation-displacement terminal fitting and to a method for producing an insulation displacement terminal fitting.

2. Description of the Related Art

A known insulation-displacement terminal fitting is disclosed in Japanese Unexamined Patent Publication No. 50(SHO)-114592. This terminal fitting has a pair of side walls and inward-facing blades on the side walls. The blades cut a resin coating of a wire inserted between the blades and contact a core of the wire. Each blade is V-shaped when viewed in an inserting direction of the wire, and is formed by embossing the flat side wall with a press so that a part of the side wall is bent into the V-shape.

The V-shaped blades typically are formed by embossing the side walls with dies disposed at the locations that are specified to define the pointed contacting edges at the leading ends of the V-shaped blades. This embossing process causes the side walls to stretch and become gradually thinner toward the pointed contacting edges. Thinning at these location may cause cracks to occur at the contacting edges formed at the leading ends of V-shaped blades.

To avoid such cracks, one might consider widening the spacing between the blades by embossing the side walls to project a smaller distance. However, a terminal fitting of this design could not accommodate thin wires. One also might consider forming the insulation-displacement terminal fitting from a relatively soft material. However, this design option may cause a deformation during an insulation-displacement connection and an insufficient contact pressure. Thus either of these design options cannot solve the above problem.

In view of the above, an object of the present invention is to prevent cracks during the embossing of V-shaped blades for an insulation-displacement connection.

SUMMARY OF THE INVENTION

The subject invention is directed to an insulation-displacement terminal fitting with at least one side wall. The side wall is embossed inwardly to form at least one substantially V-shaped blade that projects from the side wall for cutting into an insulation coating of a wire and for connection with a core of the wire. At least one weakened portion is formed at and/or near portions of the blade and/or the side walls.

The weakened portions are stretched to a large degree during embossing. Thus, a stretching degree of the blades, and preferably a stretching degree of the pointed edges at the leading ends of the V-shaped blades, can be small, thereby preventing cracks in the blades, and preferably in the pointed edges of the blades.

The weakened portions may be at least partly in the form of through holes. Additionally or alternatively, the weakened portions may be at least partly in the form of recesses formed by partial thinning.

Most preferably, the weakened portions are at and/or near portions that are continuous with the blades and the side walls.

The weakened portions may be formed to extend substantially continuously over the blades and/or the side walls.

More particularly, the weakened portions may extend in embossing directions, i.e. along the longitudinal extension of the blades and side walls.

The forming areas of the weakened portions extend distances in stretching directions that are larger than weakened portions that are formed either in the blades or in the side walls. Thus, the areas of the weakened portions are distorted only to a small degree, and as a result these portions can remain relatively thick.

Preferably, the insulation-displacement terminal fitting further comprises a bottom wall, and at least one slit is formed at least partly between the blade portions and the bottom wall.

The invention also is directed to a production method for producing an insulation-displacement terminal fitting. The method comprises providing an electrically conductive plate and forming at least one weakened portion at and/or near portions of the plate that will define blades and/or side walls. The method proceeds by embossing at least one portion of the plate that will define at least one side wall to form at least one substantially V-shaped blade projecting from the side wall for cutting into an insulation coating of wire so that the blade connects with a core of the wire.

According to a preferred method, the plate is provided such that the portions of the plate that are to be embossed have a substantially constant thickness.

Most preferably, the weakened portions are provided at least partly in the form of through holes and/or of recesses that are formed by partial thinning.

These and other objects, features and advantages of the present invention will become apparent upon reading of the following detailed description of preferred embodiments and accompanying drawings. It should be understood that even though embodiments are described separately, single features may be combined to additional embodiments.

DETAILED DESCRIPTION OF THE PREFERRED EMBODIMENTS

Figure 1:
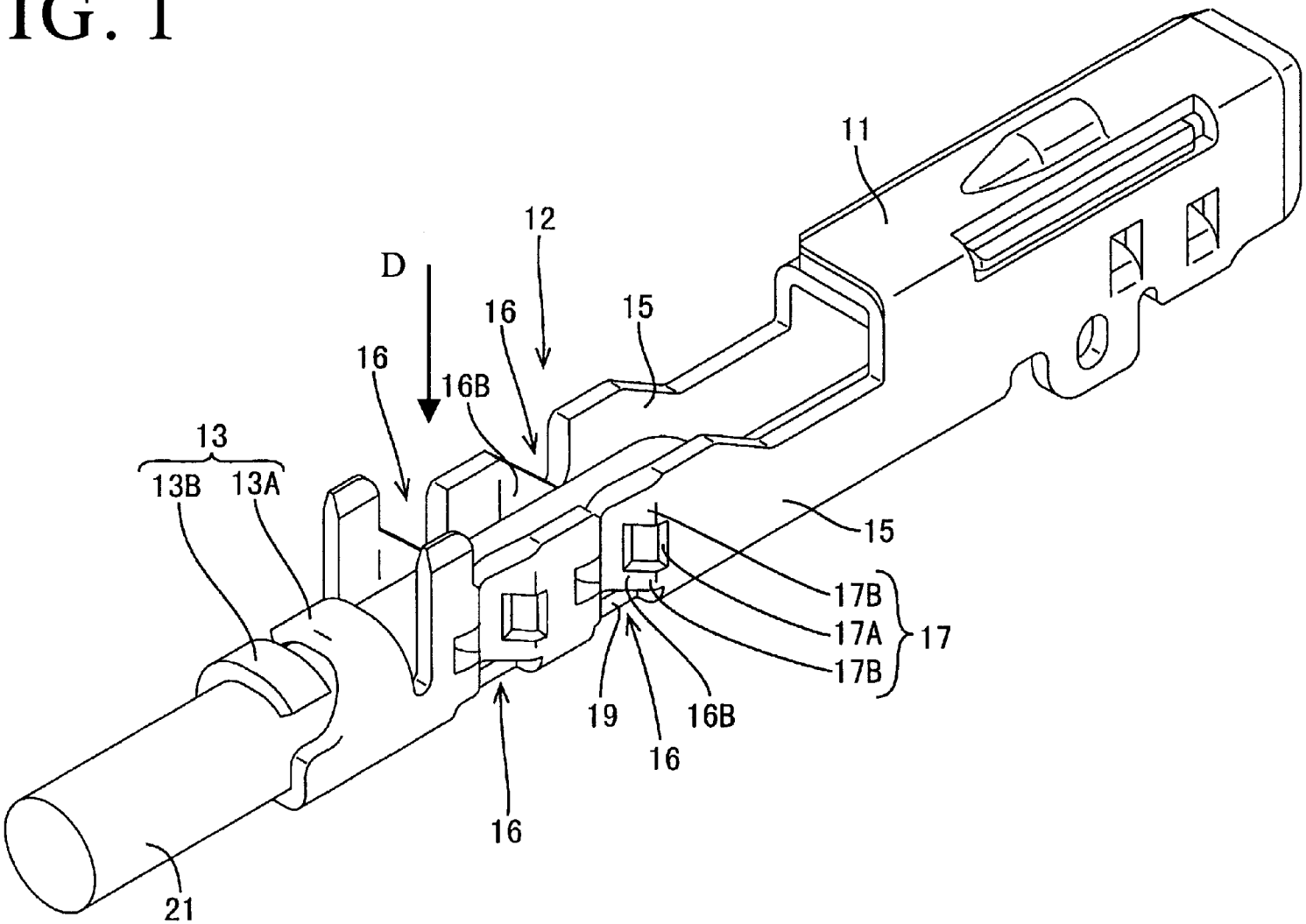
FIG. 1 is a perspective view of a first embodiment connected with a wire.
Figure 2:
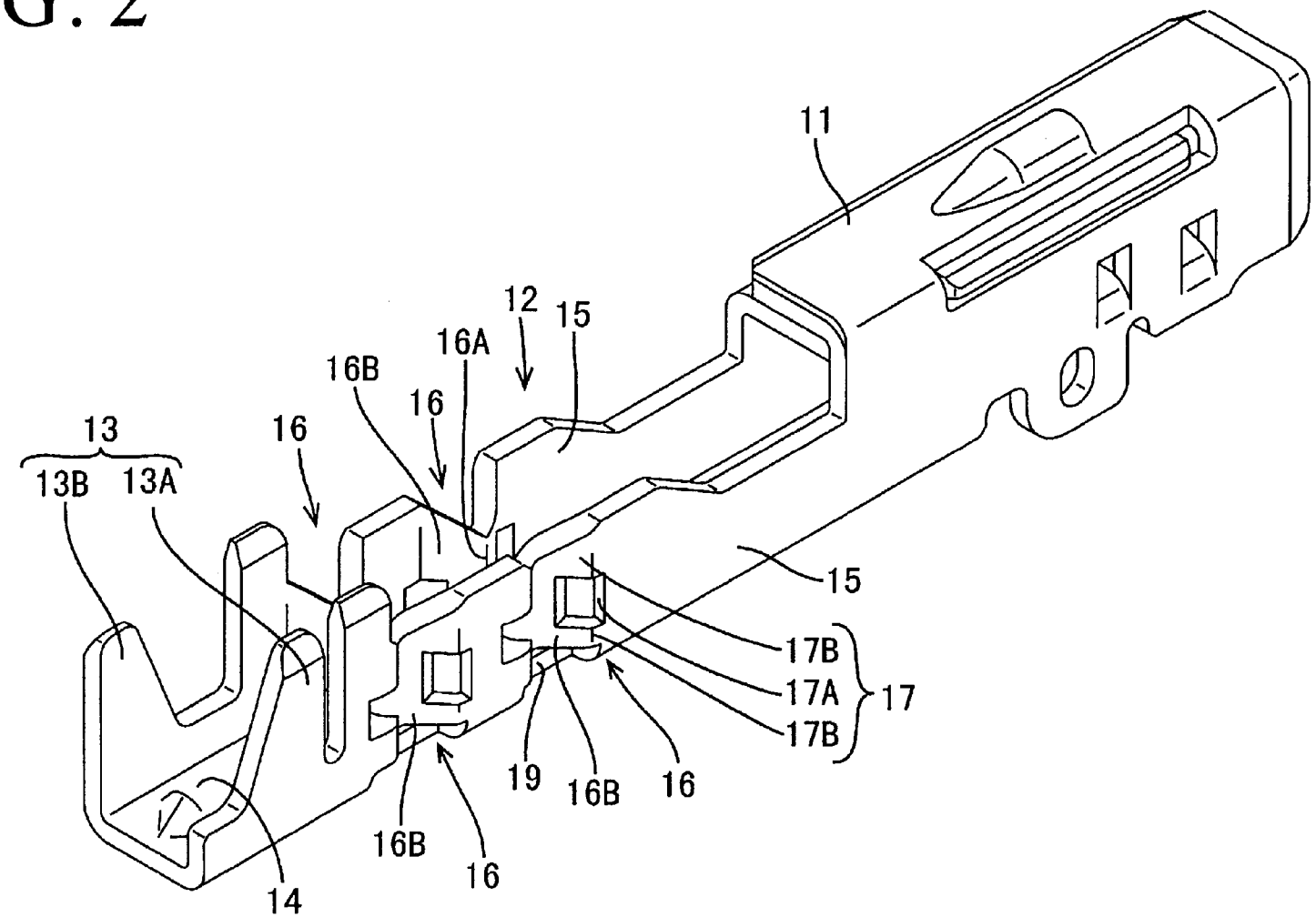
FIG. 2 is a perspective view of the first embodiment before connection with a wire.
Figure 3:
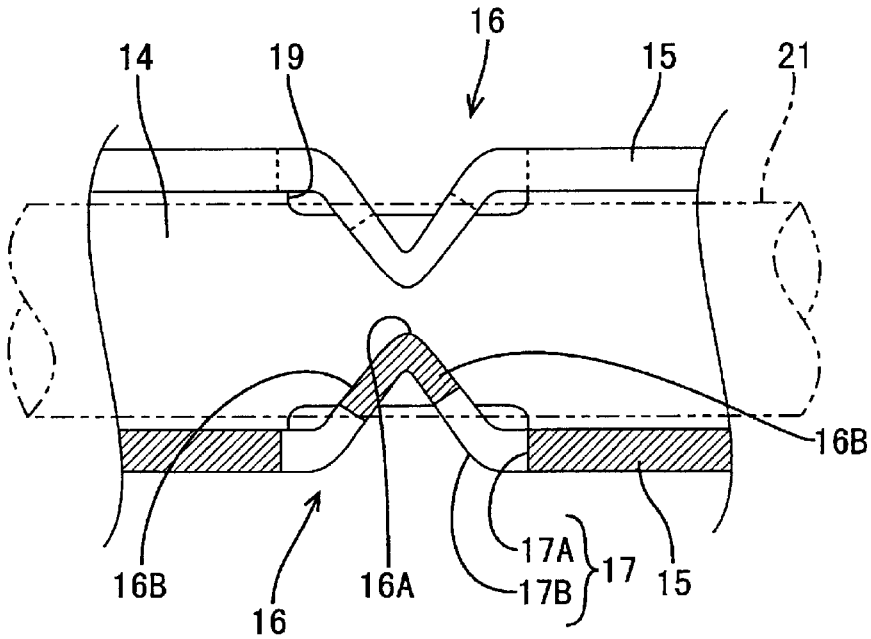
FIG. 3 is a plan view partly in section showing press-formed blade portions.
Figure 4:
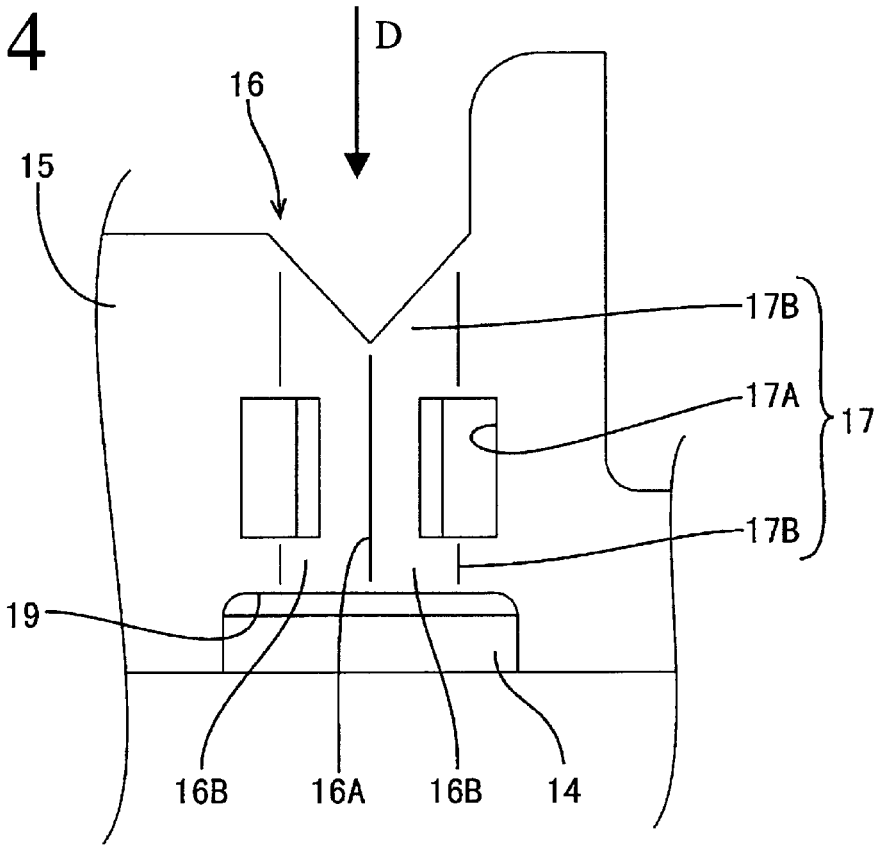
FIG. 4 is a partial side view of the press-formed blade portion.
Figure 5:
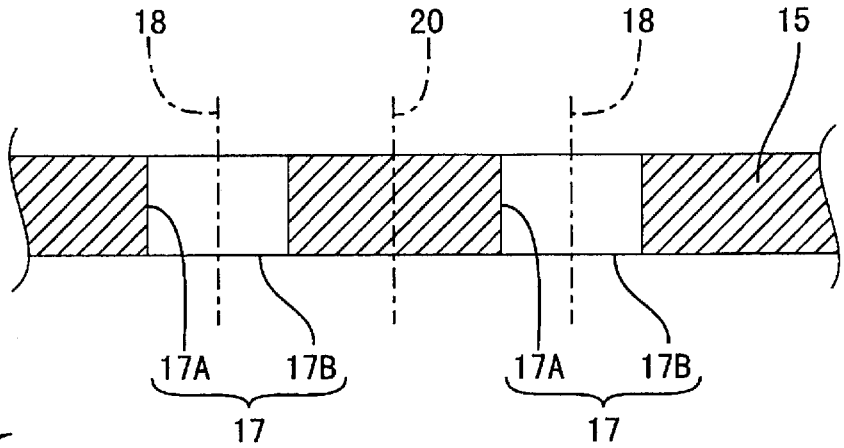
FIG. 5 is a partial section showing through holes before press-forming.

An insulation-displacement terminal fitting is formed by bending and embossing a metal plate. The plate preferably has a substantially constant thickness and is stamped out or cut in a specified shape. The insulation-displacement terminal fitting comprises an engaging portion 11, an insulation-displacement portion 12 and a crimping portion 13 which are integrally or unitarily connected with each other in this order by a common bottom wall 14, as shown in the upper right side in FIGS. 1 and 2.

The engaging portion 11 is in the form of a substantially rectangular tube that has open front and rear ends. The engaging portion 11 is formed with an elastic contact piece (not shown) that is folded up from the front edge of the bottom wall 14. Thus the elastic contact piece can be brought into contact with a tab (not shown) of a mating terminal fitting.

The crimping portion 13 is comprised of two barrel portions 13A and 13B which extend at an angle different from 0° or 180°, preferably substantially normal or upward from the left and right edges of the bottom wall 14. The barrel portions 13A and 13B preferably are displaced from each other in forward and backward directions, and can be crimped, bent or deformed into connection with the outer surface of a wire 21.

The insulation-displacement portion 12 is formed with a pair of front blades 16 and a pair of rear blades 16. The blades 16 in each pair preferably substantially face each other at the side walls 15, and are formed by embossing portions of side walls 15 inward to have a substantially V-shape when viewed from above (in a direction D in which the wire 21 is pushed into connection). Each blade 16 includes two panels 16B that intersect to define a substantially V-shaped contact edge 16A aligned substantially along the direction D in which the wire 21 is pushed into connection. When the wire 21 is pushed between the side walls 15 from above, the upper edges of the panels 16B of the blades 16 cut an insulation coating of the wire 21, so that the edges 16A of the blades 16 contact a core of the wire 21.

The terminal fitting is formed from a plate that initially is substantially planar, such that portions of the plate that will define the bottom wall 14 and the side walls 15 are substantially continuous and flush with each other. Two deformation-facilitating portions 17 are formed at locations on the plate that will define each respective blade 16. Each deformation-facilitating portion 17 includes a weakened portion 17A that preferably is in the form of a substantially rectangular through hole that is open to the inner and outer surfaces of the plate. Thus, the side wall 15 and the blade 16 are connected by connecting portions 17B that are disposed respectively above and below the weakened portion 17A. Further, a fold 18 extends through the weakened portion 17A. The fold 18 defines a boundary or transition between the side wall 15 and the panel 16B of the blade 16. Additionally, the fold 18 extends through the weakened portion 17A and continuously over the side wall 15 and the blade 16 in a stretching direction of the plate during embossing. The weakened portion 17A is formed at and/or near portions of the plate that will be continuous with the blade 16 and the side wall 15. However, the weakened portion 17A excludes the V-shaped pointed contact edge 16A. A slit 19 is formed at a boundary between the side wall 15 and the bottom wall 14 to prevent deformation of the side wall 15 from influencing the bottom wall 14 when the plate is embossed to form the blade 16.

Embossing is applied to the flat plate by an unillustrated press. More particularly, the embossing is carried out by placing a die (not shown) along folds 20 which become the V-shaped contact edges 16A of the blades 16 from outside, and by placing a mating die (not shown) along the folds 18 at the boundaries of the panels 16B and the side walls 15 from inside. In this state, the press dies are advanced inwardly, for gradually forming the blades 16.

At this time, portions of the side walls 15 are stretched in embossing directions. If the portions to be embossed simply have a constant thickness, the side walls 15 become gradually thinner toward the leading ends, which are the portions that become the edges of the substantially V-shaped blades 16. However, in this embodiment, the deformation-facilitating portions 17 are provided by forming the weakened portions 17A at the boundaries 18 between the portions of the side walls 15 left intact and portions that are to be embossed. Thus, a degree of stretching deformation (distortion) near the weakened portions 17A during embossing is set larger than the stretching deformation of portions that become the pointed contact edges 16A at the leading ends of the substantially V-shaped blades 16. Accordingly, the connecting portions 17B of the deformation-facilitating portions 17 are stretched to a large degree during embossing, with the result that the portions which become the pointed contact edges 16A at the leading ends of the substantially V-shaped blades 16 are stretched to a small degree. Thus, the thickness of the formed blades 16 is substantially constant over the entire area from the boundaries 18 with the side walls 15 to the contact edges 16A. This obviates a likelihood that portions of the blades 16 at and near the contact edges 16A become thinner or crack.

Further, a range where the weakened portions 17A are formed in the embossing or stretching direction is large as compared to a case where weakened portions are formed only in a narrow area where the blade 16 is formed. Accordingly, the degree of stretching deformation or distortion of the connecting portions 17B of the deformation-facilitating portions 17 can be small. Thus, the connecting portions 17B of the deformation-facilitating portions 17 remain relatively thick, deformation of the blades 16 resulting from a resistance created when the wire is pressed into connection can be prevented, and a specified contact pressure can be secured between the blades 16 and the core.

Figure 6:
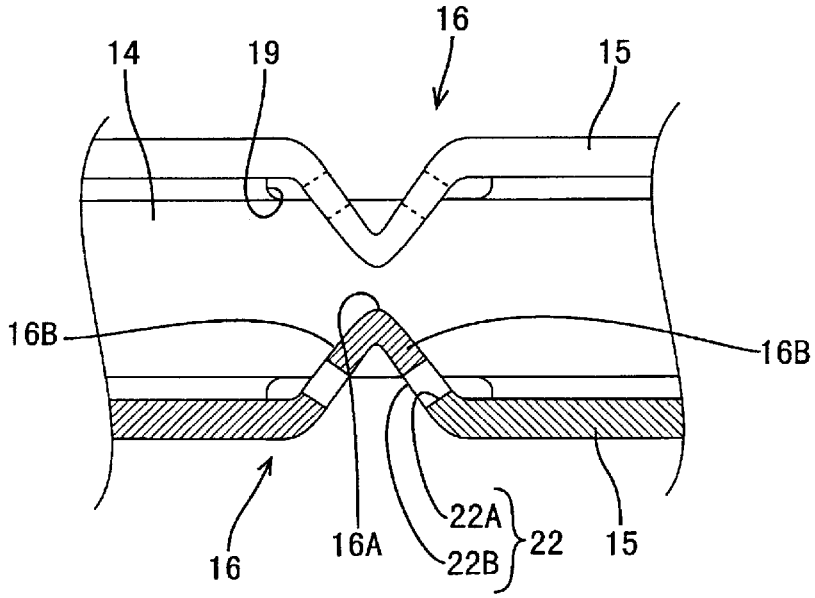
FIG. 6 is a plan view partly in section showing press-formed blade portions of a second embodiment.
Figure 7:
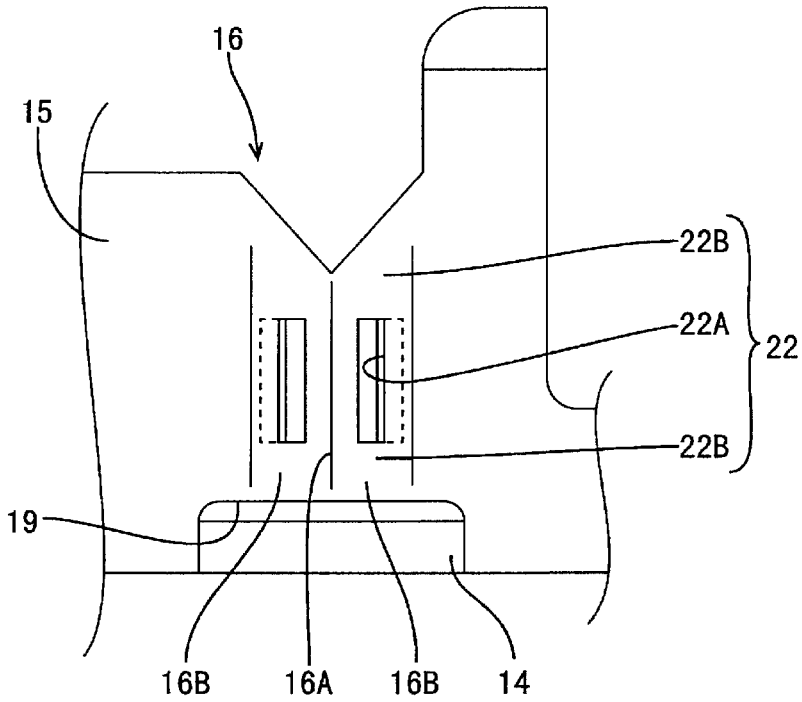
FIG. 7 is a partial side view showing the press-formed blade portion.
Figure 8:
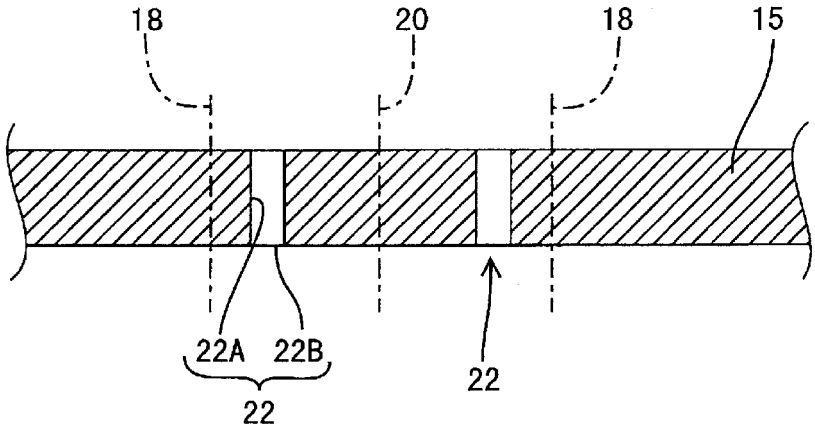
FIG. 8 is a partial section showing through holes before press-forming.

A second embodiment is illustrated in FIGS. 6–8, and differs from the first embodiment-in the forming range of deformation-facilitating portions 22. Many parts of the second embodiment are similar or identical to the first embodiment. These substantially identical parts are not described in detail, but merely are identified by the same reference numerals.

The terminal fitting of the second embodiment includes a deformation-facilitating portion 22 with a weakened portion 22A that is functionally comparable to the deformation-facilitating portion 17 of the first embodiment does. A degree of stretching deformation or distortion of connecting portions 22B above and below the weakened portion 22A during embossing is set larger than that of the portions which become the contacting edges 16A of the blade 16. The weakened portions 22A are not formed in portions of the plate that will define parts of the side walls 15 after embossing, but rather are formed substantially within a range of the panels 16B of the blade 16. Specifically, the forming area of the weakened portions 22A in the embossing direction is smaller as compared to the first embodiment. It should be noted that the vertical dimension of the forming area of the weakened portions 22A is the same as in the first embodiment.

Figure 9:
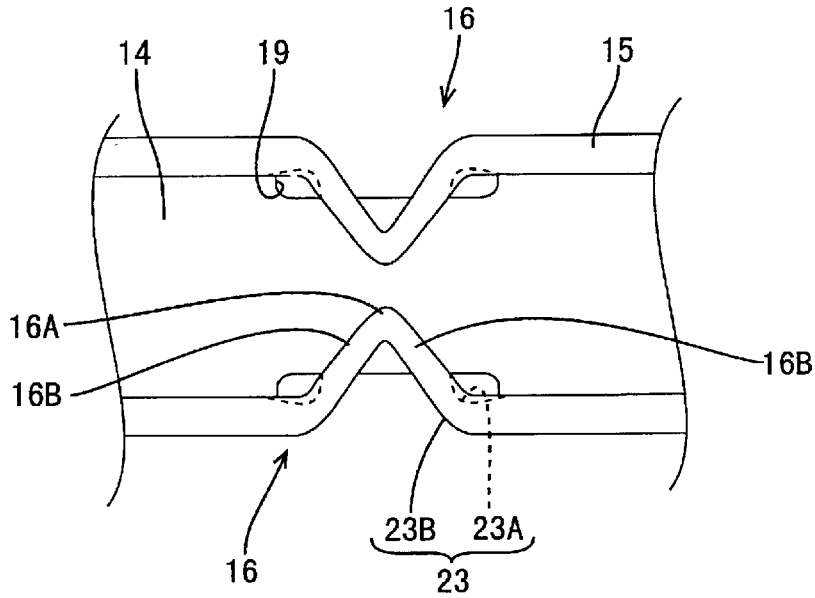
FIG. 9 is a plan view partly in section showing press-formed blade portions of a third embodiment.
Figure 10:
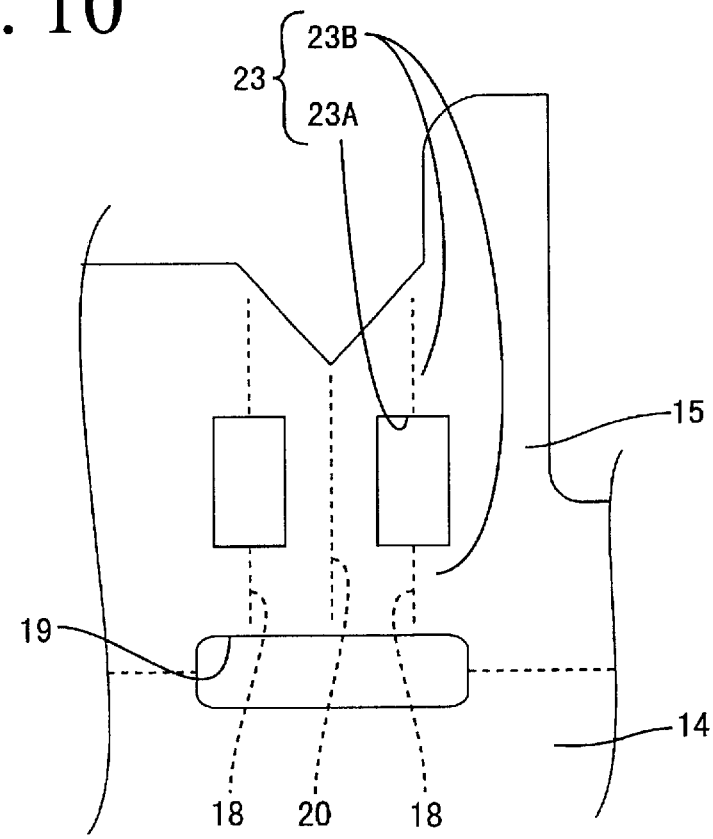
FIG. 10 is a plan view of through holes in a development of the third embodiment.
Figure 11:
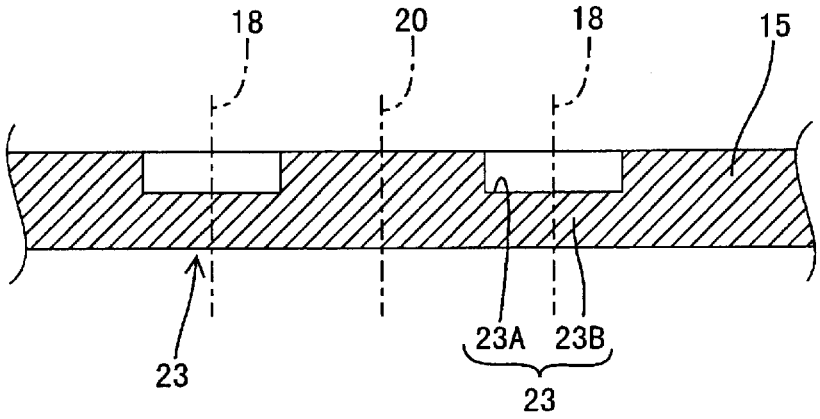
FIG. 11 is a partial section showing recessed portions before press-forming.

A third embodiment of the invention is illustrated FIGS. 9 to 11. The deformation-facilitating portions 17, 22 of the first and second embodiments include the weakened portions 17A, 22A in the form of through holes open in the inner and outer surfaces of the plate. However, deformation-facilitating portions 23 of the third embodiment include weakened portions 23A formed by stepwise thinning or recessing the inner surface of the side walls, such that the inner surfaces of the side walls 15 are thinned. A stretching degree of thick portions 23B above and below the weakened portion 23A resulting from embossing is larger than that of the portions, which become the contact edges 16A of the blade 16. The forming area of the weakened portions 23A is the same as in the first embodiment. It should be noted that no description is given to the structure, action and effects of the similar or same construction by identifying it by the same reference numerals since the third embodiment is identical to the first embodiment in the other construction.

The present invention is not limited to the above embodiments. For example, following embodiments also are embraced by the technical scope of the invention as defined in the claims. Besides these embodiments, various changes can be made without departing from the scope and spirit of the invention as defined in the claims.

Although the weakened portions are holed or thinned in the foregoing embodiments, they may be a combination of holed and thinned portions according to the present invention.

Although one pair of weakened portions are provided for each blade in the foregoing embodiments, more weakened portions may be provided and the positions thereof may be arbitrarily set according to the present invention.

Although the weakened portions are formed on the inner surfaces of the side walls in the third embodiment, they may be formed on the outer surfaces of the side walls or may be formed on both the inner and outer surfaces of the side walls.

Although the weakened portions are made stepwise thinner than the other portions before embossing in the third embodiment, they may be gradually thinned.

Although the weakened portions are formed at the blade portions or over the blade portions and the side walls in the foregoing embodiments, they may be formed only at the side walls or independent weakened portions may be separately formed in the blade portions and the side walls according to the present invention.

Although the terminal fitting was described as having two pairs of blades 16, only one pair or three or more pairs of blade portions 16 may be provided.

What is claimed is:

1. An insulation-displacement terminal fitting formed from a metal plate material, said terminal fitting having a bottom wall and two substantially parallel side walls extending upwardly from said bottom wall such that a wire receiving space is defined between said side walls and above said bottom wall, each said side wall being embossed inwardly to form at least one substantially V-shaped blade projecting from the respective side wall and into the wire receiving space for cutting into an insulation coating of a wire inserted into the wire receiving space for connection with a core of the wire, each said V-shaped blade having first and second blade panels unitarily joined to the respective side wall along first and second connecting portions, the blade panels of each V-shaped blade being unitarily joined to one another at a contact edge in the wire receiving space, each said blade panel having a weakened portion formed in a section of the blade panel adjacent the respective connecting portion and spaced from the respective contact edge, each weakened portion being formed by removing a selected amount of the metal plate material.

2. The insulation-displacement terminal fitting of claim 1, wherein the weakened portion is formed on portions of the blade panel spaced from the side wall.

3. The insulation-displacement terminal fitting of claim 1, further comprising at least one slit being formed at least partly between the blade and the bottom wall.

4. The insulation-displacement terminal fitting of claim 1, wherein the contact edge is defined at a portion of the substantially V-shaped blade most distant from the side wall for cutting the insulation coating of the wire.

5. The insulation-displacement terminal fitting of claim 4, wherein the weakened portion comprises a through hole.

6. The insulation-displacement terminal fitting of claim 4, wherein the weakened portion comprises a recess formed by partial thinning.

7. The insulation-displacement terminal fitting of claim 4, wherein the weakened portion is continuous with both the blade panel and portions of the side wall adjacent the blade panel.

8. A method for producing an insulation-displacement terminal fitting, comprising the steps of:

providing an electrically conductive plate, the plate having a bottom wall portion and first and second side wall portions unitary with the bottom wall portion for defining first and second side walls on the terminal fitting, each said side wall portion having at least one blade portion for defining a blade on the terminal fitting, each said blade portion having first and second blade panels unitary with one another along a contact;

removing at least a portion of the conductive plate on each said blade panel at locations spaced from the contact for forming at least one weakened portion on each blade panel of each said blade portion of the plate; and embossing the blade portion of the plate to form a substantially V-shaped blade projecting from the side wall for cutting into an insulation coating of wire and for connecting with a core of the wire.

9. The method of claim 8, wherein the plate initially is of a substantially constant thickness at locations spaced from the weakened portions.

10. The method of claim 9, wherein the step of forming at least one weakened portion comprises forming at least one through hole in the plate.

11. The method of claim 9, wherein the step of forming at least one weakened portion comprises forming at least one recess by partial thinning the plate.

* * * * *